US010650991B2

(12) United States Patent
Fangmann

(10) Patent No.: US 10,650,991 B2
(45) Date of Patent: May 12, 2020

(54) ELECTRIC SWITCH AND POSITION SENSOR THEREOF

(71) Applicant: Johnson Electric S.A., Murten (CH)

(72) Inventor: Gerhard Fangmann, Marienheide (DE)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 0 days.

(21) Appl. No.: 15/711,608

(22) Filed: Sep. 21, 2017

(65) Prior Publication Data

US 2018/0082808 A1 Mar. 22, 2018

(30) Foreign Application Priority Data

Sep. 21, 2016 (DE) ..... 10 2016 117 785

(51) Int. Cl.

| | |
|---|---|
| ***H01H 19/20*** | (2006.01) |
| ***H01H 9/06*** | (2006.01) |
| ***H01H 19/11*** | (2006.01) |
| ***H01H 19/58*** | (2006.01) |

(52) U.S. Cl.

CPC ..... *H01H 19/20* (2013.01); *H01H 9/061* (2013.01); *H01H 9/063* (2013.01); *H01H 19/115* (2013.01); *H01H 19/585* (2013.01)

(58) Field of Classification Search

CPC ..... H01H 19/20; H01H 19/11; H01H 19/115; H01H 19/585; H01H 19/36; H01H 19/38; H01H 19/40; H01H 9/063; H01H 2009/066; H01H 13/08

See application file for complete search history.

(56) References Cited

U.S. PATENT DOCUMENTS

| | | | | |
|---|---|---|---|---|
| 4,861,951 A * | 8/1989 | Olson | ..... | H01H 1/403 200/11 DA |
| 8,550,181 B2 * | 10/2013 | Kobayashi | ..... | H01H 13/06 173/217 |
| 8,981,244 B2 * | 3/2015 | Ho | ..... | B25F 5/00 200/11 J |

FOREIGN PATENT DOCUMENTS

| | | | | |
|---|---|---|---|---|
| DE | 102009033536 A1 * | 1/2011 | ..... | H01H 19/06 |
| EP | 0359070 A2 * | 3/1990 | ..... | H01H 19/115 |
| WO | WO 2017032564 A1 * | 3/2017 | ..... | H01H 9/04 |

* cited by examiner

*Primary Examiner* — Felix O Figueroa

(74) *Attorney, Agent, or Firm* — Muncy, Geissler, Olds & Lowe, P.C.

(57) ABSTRACT

The invention relates to an electric switch for electric devices. A changeover device is additionally provided for changing the direction of rotation of the electric motor. This changeover device includes a position sensor which is able to be operated from outside and features a haptic element.

15 Claims, 5 Drawing Sheets

ELECTRIC SWITCH AND POSITION SENSOR THEREOF

CROSS REFERENCE TO RELATED APPLICATIONS

This non-provisional patent application claims priority under 35 U.S.C. § 119(a) from Patent Application No. 10 2016 117 785.7 filed in Germany on Sep. 21, 2016.

FIELD OF THE INVENTION

The present invention relates to an electric switch and a position sensor, in particular to one used for manually operated power tools having an electric motor

BACKGROUND OF THE INVENTION

In general, electric switches of this type for manually operated power tools and appliances, such as electric drills, cordless screwdrivers, hammer drills or the like, include, an electric circuit which can be switched by an actuation element actuated from outside and a changeover device for shifting the rotation direction of the electric motor. A controller and regulation for rotational speed or torque can be provided in addition. The well-known electric switch is provided with a changeover device for changing the direction of rotation of the electric motor, meaning from clockwise to counterclockwise or vice versa. For this purpose, corresponding conducting paths are arranged for this purpose on the circuit board, and the changeover device includes a position sensor able to be operated from the outside by means of rotational movement of the position sensor, which is connected to a shift lever inside the switch housing. Rotary actuation of the position sensor causes contact tongues arranged on the shift lever to connect either with the conducting paths on the circuit board for clockwise rotation or with the conducting paths on the circuit board for counterclockwise rotation of the electric motor. This position sensor furthermore includes a haptic element.

SUMMARY OF THE INVENTION

Accordingly, there is a desire for simplified electric switch and a position sensor.

The electric switch is particularly for use in manually operated power tools having an electric motor. This electric switch includes a switch housing. Protruding from this housing is a plunger, which is connected to an actuation element and is used for manually operating the electric device. Actuation of the actuation element causes the plunger to move, namely from an initial position, where the electric device is switched off, to an on position, where the electric device is switched on because movement of the plunger causes switching of at least one contact of a contact system provided within the switch housing. A circuit board is arranged within the switch housing. This electric switch furthermore includes a device for changing the direction of rotation. The novel changeover device comprises a position sensor able to be operated from outside. This position sensor is connected to the contact arm, which has two contact tongues, whereby the contact tongues interact with conducting paths for clockwise rotation of the electric motor when the position sensor is in one position, and they interact with conducting paths for counterclockwise rotation of the electric motor when the position sensor is in another position.

The position sensor includes a tappet on its outer side. Provided on the inner side of the position sensor that faces the housing are one or more spring arms with haptic elements additionally provided for the movable mounting of the position sensor in the housing by the correspondingly constructed edge areas, as well as for providing a connection to the contact arm. Such a position sensor could advantageously be of integral design, with the tappet, the edge areas, and the spring arms being made of plastic.

In order to set clockwise or counterclockwise rotation of the electric motor, this position sensor is actuated from the outside—using a tappet, for example—either directly or via an actuator that is accessible from the outside. This setting can be made by way of a linear pushing movement of the actuator or by a rotational movement.

The position sensor includes at least one haptic element, thus providing the act of setting the position sensor with tactile feedback. In accordance with the invention, this haptic element is arranged on a spring arm that is located on the inner side of the position sensor that faces the housing. In an advantageous embodiment, the haptic element is designed to be integral with its spring arm. This spring arm possesses a spring force acting outward so that the haptic element provided on the spring arm will interact with a correspondingly designed peripheral contour of the switch housing, namely with a peripheral contour of an enclosure formed in the switch housing for retaining the position sensor.

The position sensor is held within this peripheral contour, for example by means of a retaining connection. Provided for this purpose on the inner side of the position sensor are edge areas which are designed to guarantee such a retaining connection and to enable movement of the position sensor. In order to do this, they interact with correspondingly designed guides on the housing side.

The position sensor can be variously designed in order to be movable into the different positions for clockwise or counterclockwise rotation by means of a pushing movement or by means of a rotational movement. In the case of a slidable position sensor, a recess is formed in the switch housing for retaining and guiding the position sensor. In this case, one or more spring arms are provided on the inner side of the position sensor that faces the housing, each of the spring arms including haptic elements arranged on their ends that, due to the spring force of the spring arm, engage outward into recesses in the peripheral contour of the aforementioned enclosure for the position sensor.

In an advantageous embodiment of the invention, the position sensor is made in the form of a disk. The disk is arranged in the housing parallel to the circuit board and is rotatably retained in the enclosure of the switch housing. In this case, the spring arms situated on the inner side of the position sensor possess a spring force acting radially outward so that the haptic elements are able to engage outward into recesses in the rounded peripheral contour. Said spring arm for the haptic element extends from its point of connection with the inner side of the disk in a direction peripheral to the disk. The haptic element is provided on the free end of the spring arm, and is optionally designed to be integral with the spring arm. In a particularly preferential embodiment, two spring arms are arranged to be diametrically opposed on the inner side of the disk. The respective haptic elements engage into the peripheral contour of the enclosure in the switch housing, namely the enclosure for the disk. In the case of two spring arms being provided, the enclosure includes two contoured areas, each of equal design, on opposing sides of the enclosure.

One peripheral contour on the housing side of the enclosure that is designed for the position sensor comprises at least two engagement recesses for each haptic element, namely one for the position sensor position effecting clockwise rotation of the electric motor, and another one for the position sensor position effecting counterclockwise rotation of the electric motor. Advantageously, the peripheral contour on the housing side of the enclosure for the position sensor can furthermore be provided with a stop which restricts the movement of the position sensor, namely only allowing movement between the aforementioned positions for clockwise and counterclockwise rotation. Also, in a further embodiment, an additional enclosure can be constructed for the neutral position between these engagement positions.

The advantageous and novel position sensor for the novel electric switch is of simple design. The haptic element is arranged on the spring arm and is optionally designed also to be integral with the position sensor. In contrast to the prior art changeover device, no additional element needing to be mounted within the position sensor, and in particular no spring, will be necessary for the haptic effect.

DETAILED DESCRIPTION OF THE PREFERRED EMBODIMENTS

The technical solutions of the embodiments of the present invention will be clearly and completely described as follows with reference to the accompanying drawings. Apparently, the embodiments as described below are merely part of, rather than all, embodiments of the present invention. Based on the embodiments of the present invention, any other embodiment obtained by a person skilled in the art without paying any creative effort shall fall within the protection scope of the present invention.

It is noted that, when a component is described to be "fixed" to another component, it can be directly fixed to the another component or there may be an intermediate component. When a component is described to be "connected" to another component, it can be directly connected to the another component or there may be an intermediate component. When a component is described to be "disposed" on another component, it can be directly disposed on the another component or there may be an intermediate component.

Unless otherwise specified, all technical and scientific terms have the ordinary meaning as commonly understood by people skilled in the art. The terms used in this disclosure are illustrative rather than limiting. The term "and/or" used in this disclosure means that each and every combination of one or more associated items listed are included.

Figure 1:
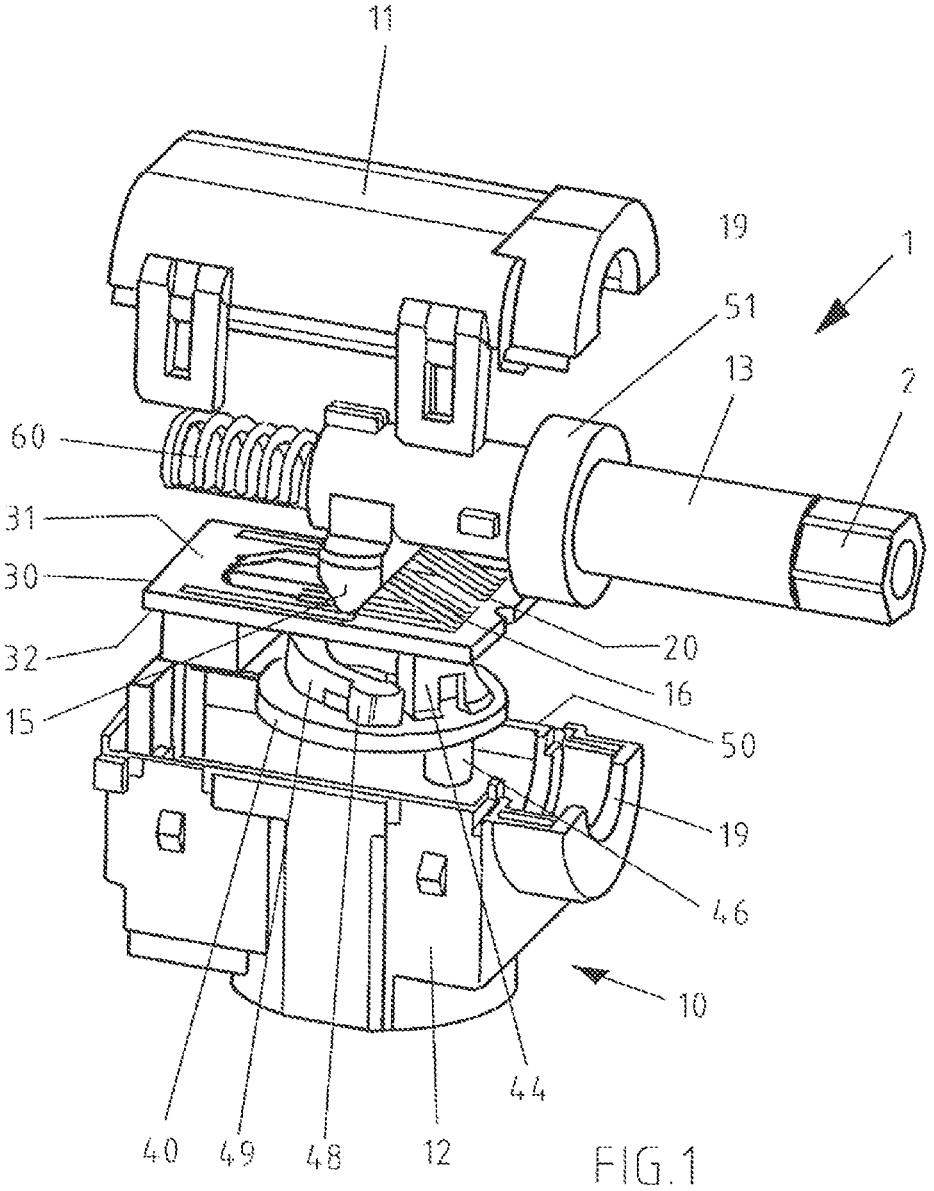
FIG. 1 is a perspective view of an electric switch according to one embodiment of the present invention.

FIG. 1 illustrates an electric switch 1 in accordance with one embodiment of the present invention. The electric switch 1 may be used for manually operated power tools and appliances having an electric motor, for example electric drills, cordless screwdrivers, hammer drills and the like. For this purpose, this electric switch 1 is incorporated into a switch housing of the power tool and a plunger 13 of the electric switch 1 is connected to, for example, a manually actuator via a connection 2. An electrical cable (not shown) extends from the electric switch 1 and is connected to the electric motor. A changeover device 40, which is inside the switch housing 10 of the electric switch 1 and is adjustable from the outside via a tappet 46, is used for setting the direction of rotation of the electric motor in a power tool and interacts with, for example, a corresponding shift lever, which can be adjusted from the outside.

The switch housing 10 of the electric switch 1 shown in FIG. 1 comprises two shells, namely an upper shell 11 and a lower shell 12. Provided between the shells 11,12 is a one-piece circumferential seal 50, which comprises a ring 51 in the area of an opening 19. Within the switch housing 10, the plunger 13 is connected to a slider 15, which is movably arranged above an upper surface 31 of a circuit board 30 and is able to perform a linear pushing movement. The circuit board 30 is immovably arranged in the switch housing 10. This pushing movement of the plunger 13 leads the displacement of a sliding contact 16 onto contact surfaces which are designed for regulating rotational speed and are provided on the upper surface 31 of the circuit board 30. The displacement path of the sliding contact 16 changes the resistance and, therefore, the rotational speed and the torque of the electric motor connected to the switch 1. Sliding contacts of a contact system 20 are also movably arranged on the upper surface 31 of the circuit board 30 and the sliding contacts acting on corresponding contact surfaces on the upper surface 31 of the circuit board 30, thus causing switching in the contact system, namely from the off position to the on position. The plunger 13 in this example is spring-loaded. A return spring 60 acts to automatically return the plunger 13 to the off position as soon as pressure is no longer being exerted on the plunger 13.

Figure 2:
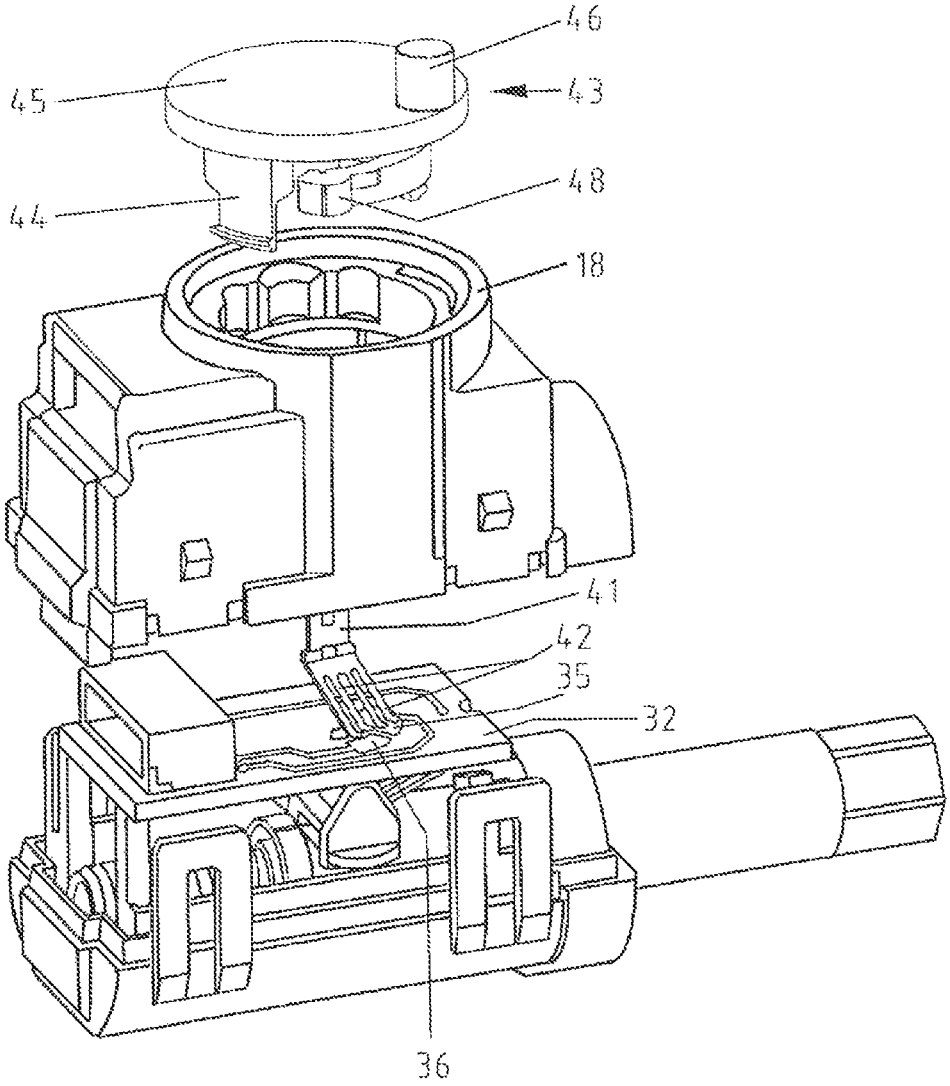
FIG. 2 is a perspective view of the electric switch of FIG. 1, viewed from another aspect.
Figure 7:
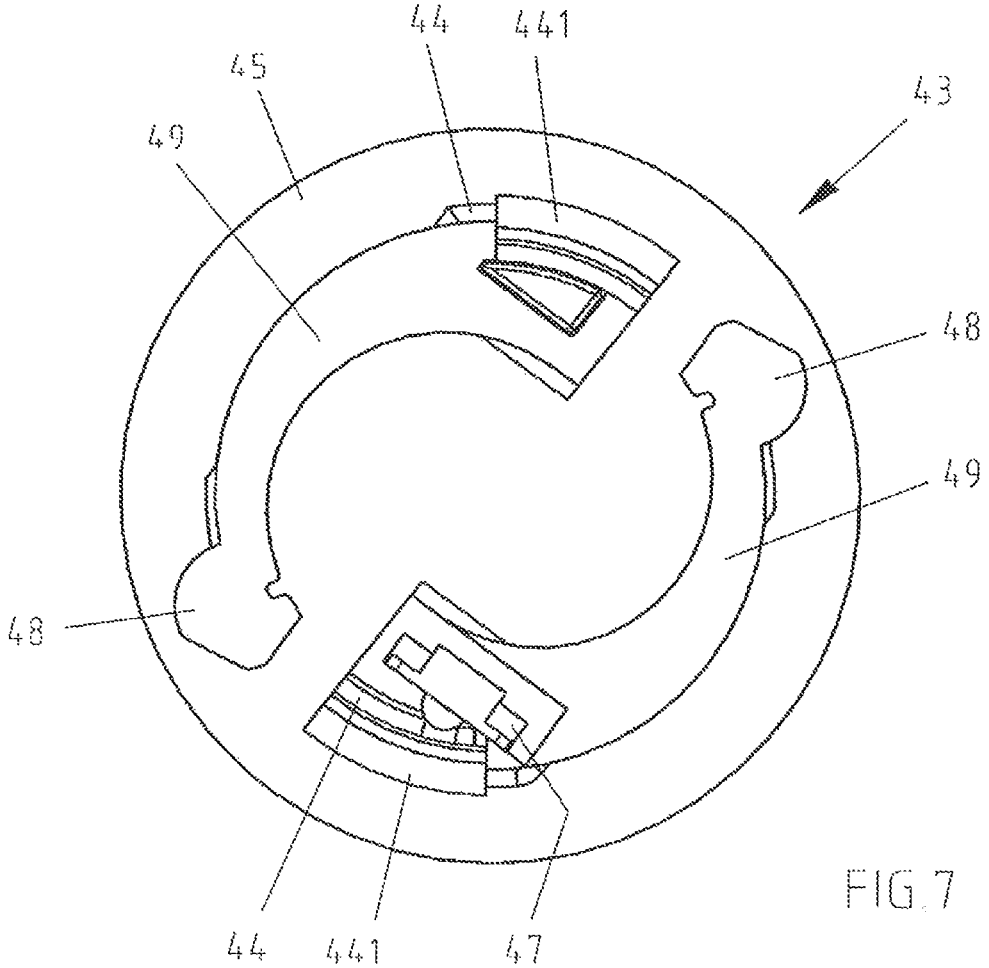
FIG. 7 is a perspective view of the position sensor of FIG. 6, viewed from another aspect.

Contact surfaces in the form of conducting paths 35,36 are likewise provided on a lower surface 32 which is the opposite surface of the upper surface 31 of the circuit board 30 (see FIG. 2). These conducting paths 35,36 are part of the changeover device 40 and contact to a contact tongues 42 of a contact arm 41, meaning that a contact bridge is formed either for the conducting path 35 for counterclockwise rotation of the electric motor, or, in another position of the contact arm 41, a contact bridge is formed for the conducting path 36 for clockwise rotation of the electric motor. Setting clockwise rotation or counterclockwise rotation is accomplished using a position sensor 43, on the inner side of which the contact arm 41 is arranged. As is better understood from FIG. 7, a mounting slit 47 for this contact arm 41 is located on the lower side of the position sensor 43. The contact arm 41 can be held in this mounting slit 47 by way of a form fit or an interference fit.

The position sensor 43 is retained in an enclosure 18 on the switch housing 10, in the at least one embodiment, the enclosure 18 is located in the lower shell 12 of the switch housing 10. In at least one embodiment, the position sensor 43 comprises a rotatable disk 45 and a tappet 46 provide on the outer side of the disk 45 for rotational actuation of the disk 45. The tappet 46 either protrudes directly from the housing of the electric device or, preferably, is connected to a shift lever that is adjustable from the outside. In order to switch over the direction of rotation of the electric motor, the tappet 46 is moved and then the disk 45 is rotated in the enclosure 18 of the switch housing 10 for setting clockwise or counterclockwise rotation of the electric motor.

Figure 6:
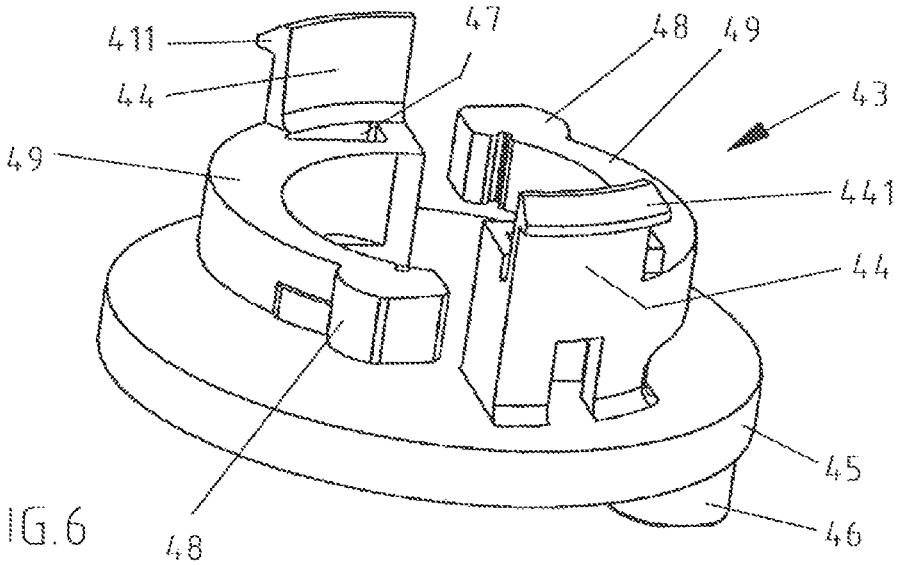
FIG. 6 is a perspective view of the position sensor.

The inner side of the disk 45 is shown in FIG. 6. Edge areas 44 are arranged on this inner side of the disk 45 for the disk 45 movable mounting in the enclosure 18 of the housing 10. These edge areas 44 protrude into the enclosure 18, and the exterior ends of their outer edges 441 of these edge areas 44 are designed to be hook-shaped, thus enabling them to hold the position sensor 43 in the enclosure 18 of the switch housing. In at least one embodiment, the disk 45 is held in the enclosure 18 via a clamping or a latching connection during rotational movement and in the individual rotational positions. These edge areas 44 are thus designed to be thin enough for the elasticity required in such a connection, yet thick enough that they will securely hold the disk 45 in the enclosure 18. Corresponding guides are provided in the enclosure 18 for the hook-shaped ends of the engagement areas 44.

As can be understood from FIG. 6, there are two spring arms 49 furthermore arranged on the lower side of the disk 45. One end of the spring arms 49 are connected to the disk 45. In at least one embodiment, the spring arms 49 are designed to be integral with the disk 45. The spring arms 49 are extended in a peripheral direction, and a haptic element 48 is provided on the free end of the spring arm 49. The haptic element 48 is projected outward beyond the spring arm 49 and is pushed outward by the spring force of the spring arm 49. The purpose of the haptic elements 48 is to provide the individual rotational positions of the position sensor 43 with tactile feedback.

Figure 3:
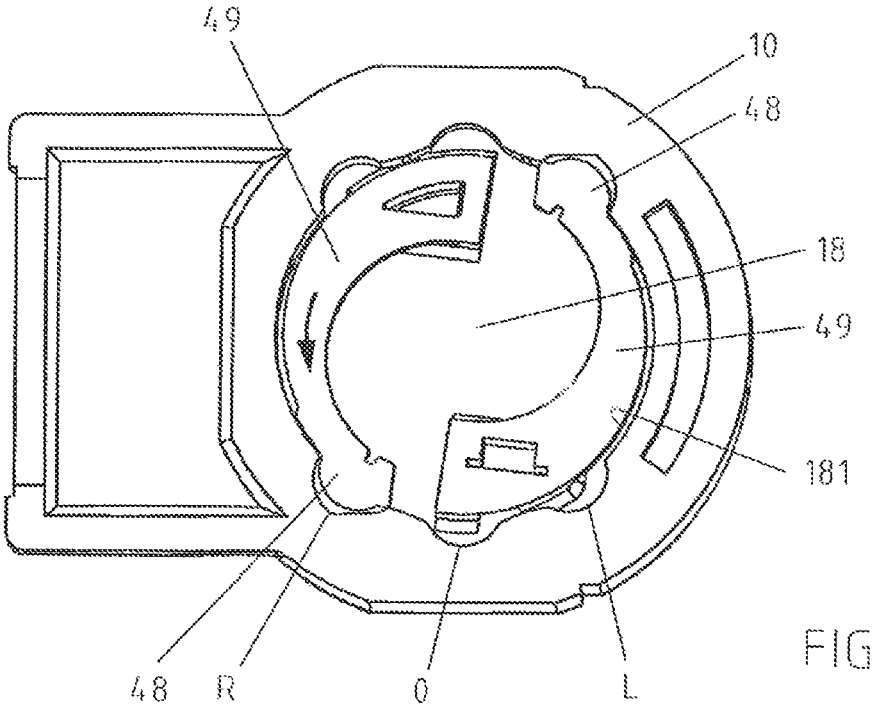
FIG. 3 is a view of an installed position sensor in the clockwise rotation.
Figure 4:
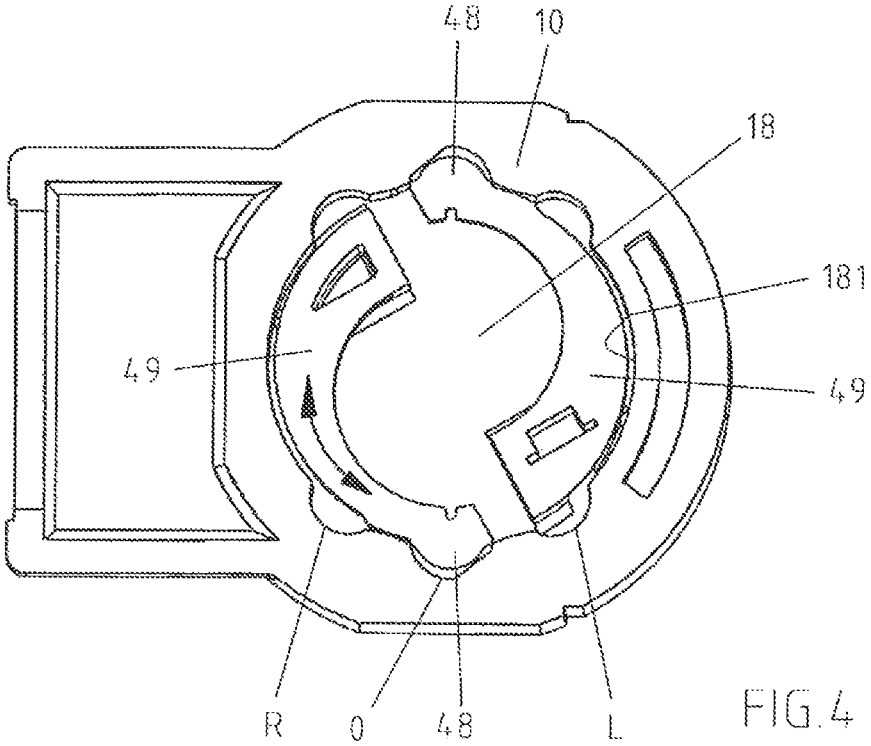
FIG. 4 is a view of the installed position sensor of FIG. 3 in the neutral position.
Figure 5:
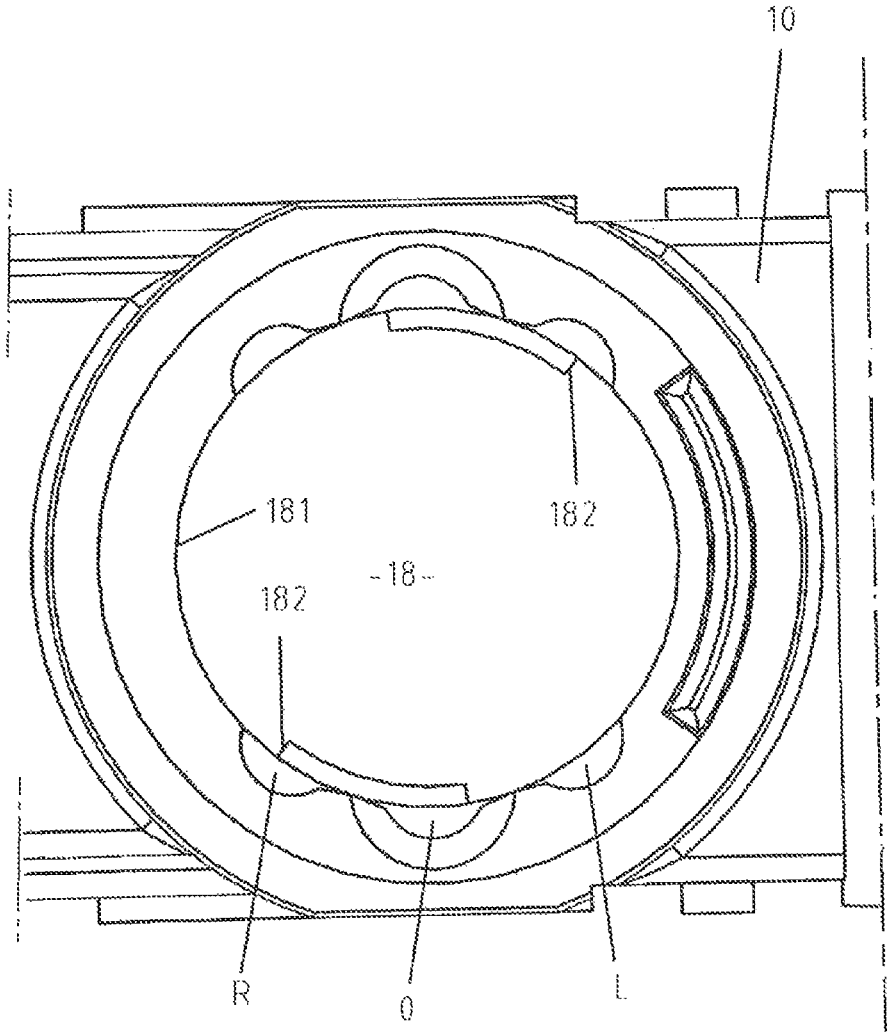
FIG. 5 is a sectional view of a switch housing of FIG. 1.

The disk 45 of the position sensor 43 is rotatably mounted in the enclosure 18 in the switch housing 10. FIG. 3 shows the position sensor 43 inserted into the enclosure 18 as seen from below. The haptic elements 48 therein are pushed radially outward by the spring arms 49, and the haptic elements 48 are pushed into corresponding recesses and namely, in FIG. 3, into recess R. In this rotational position of the position sensor 43, the contact tongues 42 of the contact arm 41 contact the conducting paths 36 on the circuit board 30 that effect clockwise rotation of the electric motor. If the position sensor 43 is rotated via the exterior tappet 46, namely in the direction of the arrow, then the rotational position according to FIG. 4 will next be reached, which is where the haptic elements 48 will engage into a recess 0 for the neutral position, and the electric motor does not move. Further rotation will allow the haptic elements 48 to engage into recess L. In this position, the contact tongues 42 contact the conducting paths 35 for counterclockwise rotation of the electric motor. In at least one embodiment, the peripheral contour 181 of the enclosure 18 is seen even better in FIG. 5, namely with recesses R, 0, and L on two diametrically opposed sides of the enclosure 18 for interacting with the two haptic elements 48, which are likewise arranged diametrically opposite on the position sensor 43. In at least on embodiment, the number of recesses is three, in other embodiments, it will be appreciated, however, that the number of recesses may be dependent on the type of switch housing 10 to be produced.

In addition, stops 182 are constructed on the peripheral contour 181. These stops 182 are configured to restrict the rotational movement of the disk 45, meaning that only backward movement of the position sensor 43 is possible as soon as the haptic elements 48 engage into the recess L because the outer edges 441 of the edge area 44 will strike and be blocked by this stop 182, thus preventing further rotation of the disk 45.

It is advantageous for the individual parts of the position sensor 43 to be constructed of plastic, namely in this case the disk 45 having the tappet 46, having the edge areas 44, as well as having the spring arms 49. Exemplary plastics materials might include acrylonitrile-butadiene-styrene, polyamides, polycarbonate, polypropylene, and/or polystyrene The invention is not limited to above embodiments. The position sensor in above examples is constructed as a disk 45 rotatably mounted in the switch housing 10. However, it is likewise possible to move a position sensor into the various positions for clockwise or counterclockwise rotation of the electric motor by means of a pushing movement. Meanwhile, one or more spring arms can be provided on the inner side of the position sensor, the spring arms pushing haptic elements arranged on their respective ends outward into a corresponding contour in the enclosure made for such a position sensor 43.

The above embodiments are merely to illustrate the technical solutions of the present invention and are not intended to limit the present invention. Although the present invention has been described with reference to the above preferred embodiments, it should be appreciated by those skilled in the art that various modifications and variations may be made without departing from the spirit and scope of the present invention.

The invention claimed is:

1. A position sensor, retained in a housing, the position sensor comprising:

a disk;

at least two spring arms arranged on one plane surface of the disk, the at least two spring arms respectively comprising first ends fixed on the disk and second ends being free ends; the first ends of the at least two spring arms respectively located at positions which are separated from each other at substantially 180° according to a center point of the disk both ends of the position sensor substantially along a diameter direction of the position sensor; and a haptic element provided on the free end of the each of at least two spring arms and the haptic element configured to provide individual rotational positions of the position sensor with tactile feedback;

wherein the tactile feedback is produced by the haptic element forced against with the housing by a spring force of the at least two spring arms.

2. The position sensor of claim 1, wherein the haptic element is designed to be integral with the at least two spring arms.

3. An electric switch applied in an electric appliance having an electric motor, the electric switch comprising:

a circuit board located in a switch housing of the electric switch, a conducting path for clockwise rotation of the electric motor and a conducting path for counterclockwise rotation of the electric motor arranged on the circuit board;

a changeover device configured to movably contact one of the conducting paths for changing the rotation direction of the electric motor according operated from outside;

the changeover device comprising a position sensor, wherein the position sensor comprises a disk, at least two spring arms and corresponding haptic elements, the at least two spring arms are arranged on one plane surface of the disk independent of each other in structure, first ends of the at least two spring arms respectively fixed on the disk and second ends of the at least two spring arms being free ends; the first ends of the at least two spring arms are respectively located at positions which are separated from each other at substantially 180° according to a center point of the disk; the haptic elements are provided on the free end of the at least two spring arms respectively and the haptic elements configured to provide individual rotational positions of the position sensor with tactile feedback;

wherein the tactile feedback is produced by the haptic elements forced against with the housing by a spring force of the at least two spring arms;

wherein the individual rotational position of the position sensor is different when the changeover device is connected to different conducting paths.

4. The electric switch of claim 3, wherein the position sensor is integrally formed.

5. The electric switch of claim 3, wherein the switch housing comprises a peripheral contour with at least two recesses for positioning the haptic elements.

6. The electric switch of claim 3, wherein the haptic elements are projected outward beyond the at least two spring arms.

7. The electric switch of claim 3, wherein the changeover device comprises a contact arm which has at least one contact tongue, wherein the contact tongue interact with the conducting paths for clockwise rotation of the electric motor when the position sensor is in one position, or interact with the conducting path for counterclockwise rotation of the electric motor when the position sensor is in another position.

8. The electric switch of claim 3, wherein the at least two spring arms are arranged on an inner side of the position sensor and a tappet for actuation is provided on the outer side of the position sensor, where in the tappet is configured to set the direction of rotation of the electric motor form the outside.

9. The electric switch of claim 5, wherein the position sensor is a disk and there are two spring arms with haptic elements are provided on the inner side of the disk, wherein the spring arms are arranged to be diametrically opposed and, given a rotational movement of the disk, to each interact with a region of the peripheral contour of the switch housing having the same design.

10. The electric switch of claim 9, wherein edge areas are arranged on the inner side of the position sensor and protrude into the switch housing to guarantee an engaging connection between the position sensor and the switch housing.

11. The electric switch of claim 10, wherein edge areas are designed to be elastic, and the free outer edge of the edge areas is designed to be hook-shaped.

12. The electric switch of claim 10, wherein rotational movement of the disk is restricted by at least one stop in an area of the peripheral contour of the switch housing.

13. The electric switch of claim 10, wherein the position sensor is designed to be integral with the tappet, the edge areas, and the spring arms, and to be made of plastic.

14. The electric switch of claim 10, wherein a mounting slit is disposed on the interior side of the position sensor for retaining the contact arm.

15. The electric switch of claim 3, wherein a device for setting a rotational speed or a torque of the electric motor is additionally provided in the switch housing, wherein this device is arranged together with a contact system for switching on one surface of the circuit board, and the position sensor is arranged on the other surface of the circuit board.

* * * * *